US007918354B2

(12) United States Patent
Shan

(10) Patent No.: US 7,918,354 B2
(45) Date of Patent: Apr. 5, 2011

(54) CONTAINER LIFTER BEING ABLE TO LIFT TWO 40 FEET CONTAINERS

(75) Inventor: Jianguo Shan, Shanghai (CN)

(73) Assignee: Shanghai Zhenhua Port Machinery Co., Ltd., Shanghai (CN)

( * ) Notice: Subject to any disclaimer, the term of this patent is extended or adjusted under 35 U.S.C. 154(b) by 0 days.

(21) Appl. No.: 11/342,309

(22) Filed: Jan. 27, 2006

(65) Prior Publication Data

US 2006/0243724 A1 Nov. 2, 2006

Related U.S. Application Data

(63) Continuation of application No. PCT/CN2004/000825, filed on Jul. 19, 2004.

(30) Foreign Application Priority Data

Jul. 30, 2003 (CN) ..... 03 1 41943

(51) Int. Cl.
*B66C 1/10* (2006.01)

(52) U.S. Cl. ..... 212/323; 212/316; 212/274; 294/81.1

(58) Field of Classification Search ..... 212/274, 212/316, 323, 374; 294/81.1
See application file for complete search history.

(56) References Cited

U.S. PATENT DOCUMENTS 3,502,365 A * 3/1970 Callow ..... 294/81.1
3,536,351 A * 10/1970 Zweifel et al. ..... 294/81.1
3,671,069 A * 6/1972 Martin et al. ..... 294/81.1
3,704,796 A 12/1972 Dedons et al.
3,747,970 A * 7/1973 Fathauer et al. ..... 294/81.1
3,807,582 A 4/1974 Anderson
3,812,987 A 5/1974 Watatani
3,837,503 A * 9/1974 Komatsu ..... 212/83
3,888,536 A 6/1975 Durenec
4,035,010 A 7/1977 Kawashita et al.
4,244,615 A 1/1981 Brown
4,563,030 A 1/1986 Makino
(Continued)

FOREIGN PATENT DOCUMENTS

CN 2225462 4/1996
(Continued)

OTHER PUBLICATIONS

Office Action mailed on Nov. 13, 2007 and received in the co-pending U.S. Appl. No. 11/360,463, filed Feb. 23, 2006.

*Primary Examiner* — Thomas J Brahan
(74) *Attorney, Agent, or Firm* — Dorsey & Whitney LLP

(57) ABSTRACT

The invention is a container lifter which is able to lift two 40 foot containers at a time. It includes two sets of the crane main lifting mechanisms with the wire rope winding systems being separate. Pulleys arranged at the crane upper frame cooperate with two lifting pulley groups arranged on the carrier. The first crane lifting mechanism and the second crane lifting mechanism are equipped with a barrel, a crane lifting mechanism motor, a brake and a crane lifting reduction gear box respectively The two sets of the crane lifting mechanisms are synchronously operated. By using the container lifter of the invention, the efficiency of the load and unload is increased, high repayment is obtained with less increasing the equipment cost, the larger beneficial result is occurred, also it has the wider applicable prospect.

2 Claims, 4 Drawing Sheets

U.S. PATENT DOCUMENTS

| | | | | |
|---|---|---|---|---|
| 5,039,275 | A | 8/1991 | Ide | |
| 5,183,305 | A | 2/1993 | Nordstrom et al. | |
| 5,671,912 | A | 9/1997 | Langford et al. | |
| 5,718,550 | A | 2/1998 | Lanigan et al. | |
| 5,775,866 | A | 7/1998 | Tax et al. | |
| 5,871,249 | A | 2/1999 | Williams | |
| 5,923,270 | A | 7/1999 | Sampo et al. | |
| 5,951,226 | A | 9/1999 | Fantuzzi | |
| 6,145,680 | A * | 11/2000 | Jussila et al. | 212/274 |
| 6,312,213 | B1 | 11/2001 | Stinis | |
| 6,354,782 | B1 | 3/2002 | Barry | |
| 6,602,036 | B2 | 8/2003 | Takehara et al. | |
| 6,698,990 | B1 | 3/2004 | Dobner et al. | |
| 6,715,977 | B2 | 4/2004 | Dobner et al. | |
| 6,920,963 | B2 | 7/2005 | Faller | |
| 7,032,763 | B1 | 4/2006 | Zakula, Sr. et al. | |
| 2003/0168871 | A1 | 9/2003 | Geis | |
| 2003/0189348 | A1 | 10/2003 | Lindstrom | |
| 2004/0032140 | A1 | 2/2004 | Solstad | |
| 2006/0043748 | A1 * | 3/2006 | Stinis et al. | 294/81.51 |

FOREIGN PATENT DOCUMENTS

| | | | |
|---|---|---|---|
| CN | 1155664 | | 7/1997 |
| CN | 2373421 | | 4/2000 |
| CN | 1415529 | | 5/2003 |
| CN | 1448331 | | 10/2003 |
| CN | 2599327 | | 1/2004 |
| CN | 2628508 | | 7/2004 |
| CN | 1579916 | | 2/2005 |
| DE | 1274299 | B | 8/1968 |
| DE | 38 38 058 | A1 | 5/1990 |
| EP | 1 650 156 | A | 5/1990 |
| FR | 828297 | A | 5/1938 |
| GB | 876647 | | 9/1961 |
| JP | 55-035722 | A | 3/1980 |
| JP | 8 175784 | A | 7/1996 |
| JP | 09-77467 | A * | 3/1997 |
| JP | 9-267987 | | 10/1997 |
| JP | 10-265717 | A * | 10/1998 |
| JP | 10-324493 | | 12/1998 |
| JP | 2001/240372 | A | 9/2001 |
| JP | 2001/240372 | A | 9/2001 |
| JP | 2002068481 | A | 3/2002 |
| WO | WO 98/34127 | | 8/1998 |
| WO | WO 01/58797 | A1 | 8/2001 |
| WO | WO 01/98195 | A1 | 12/2001 |
| WO | WO 2005/009885 | A1 | 2/2005 |

* cited by examiner

CONTAINER LIFTER BEING ABLE TO LIFT TWO 40 FEET CONTAINERS

CROSS-REFERENCE TO RELATED APPLICATIONS

This application is a continuation of International Application No. PCT/CN2004/000825, filed on Jul. 19, 2004, which claims priority to Chinese Patent Application No. 03141943.7, filed Jul. 30, 2003, the contents of which are incorporated in their entirety by reference herein.

FIELD OF INVENTION

The invention generally relates to hoisting equipment, more specifically to a bank-run container crane which is able to hoist two 40 feet containers at a time.

DESCRIPTION OF THE PRIOR ART

The increasing requirements of container transportation in the world and the continuous increment of the handling capacity of the container port put forward new and increased demands on the technical equipment for loading and unloading containers, and an urgent need for the design and development of high efficient bank-run container load and unload systems to meet the demand of the crane productivity needed by the larger ships.

Currently, cranes are only able to hoist only one 40 feet container at a time and its efficiency is low.

SUMMARY OF INVENTION

An object of the invention is to provide a container crane for hoisting two 40 feet containers at a time so as to improve the low efficiency of the container crane of the prior art, which is able to hoist only one single 40 feet container at a time.

The technical scheme of the invention is as follows:

A container crane for hoisting two 40 feet containers at a time, comprising: a first hoisting device, the first hoisting device comprises a first head block, a first spreader, a first winding barrel, a first hoisting mechanism motor, a first brake, a first hoisting reduction gear box, a first head block pulley and a first hoisting pulley, wherein the first hoisting pulley is arranged on a trolley and the first head block pulley is arranged on the first head block; a second hoisting device, the second hoisting device comprises a second head block, a second spreader, a second winding barrel, a second hoisting mechanism motor, a second brake, a second hoisting reduction gear box, a second head block pulley and a second hoisting pulley, wherein the second hoisting pulley is arranged on the trolley and the second head block pulley is arranged on the second head block; a connection cylinder, for approaching and separating the first head block and the first spreader mounted thereon and the second head block and the second spreader mounted thereon in a direction perpendicular to the length of the containers; and a wire rope winding system, for connecting the first hoisting device and the second hoisting device through a first hoisting wire rope and a second hoisting wire rope, so as to make the first hoisting device and the second hoisting device to work simultaneously.

The highly efficient container load and unload equipment of the invention is able to hoist two 40 feet containers at a time so that the efficiency of the load and unload operation is increased by at least 60% compared to the prior art, thus the high repayment is obtained with correspondingly less increase in the equipment cost, a beneficial result is obtained, also it has the wider applicable utility. The container crane of the present invention hoists two 40 feet containers at a time, and has overcome the following eight difficulties:

1. the change of the gap between two 40 feet containers;
2. the arrangement of two 40 feet containers;
3. the arrangement of two 40 feet containers in the length direction is a slightly trapezoid form;
4. the position deviation of two 40 feet containers in the length direction;
5. one end of the two 40 feet container being higher than another end of same (i.e. longitudinal slope);
6. the top planes of two 40 feet container are not horizontal, there is a angle between the top plane and a horizontal plane;
7. the two 40 feet containers are not aligned parallel with the main guided way of the container crane;
8. the overloading of two 40 feet containers.

The invention uses two separate hoisting devices, the separation, differential in height, shifting, included angle and releasing of the two hoisting devices are achieved by the cylinders, the cylinders can be separated so that the separation of the two hoisting devices can be obtained.

Each hoisting device is driven by a separate hoisting mechanism, and the two hoisting mechanisms are connected by as wire rope winding system. The separation of the two 40 feet containers can be achieved by the cylinders connecting the two hoisting devices.

BRIEF DESCRIPTION OF APPENDED DRAWINGS

DETAILED DESCRIPTION OF PREFERRED EMBODIMENTS

Figure 2:
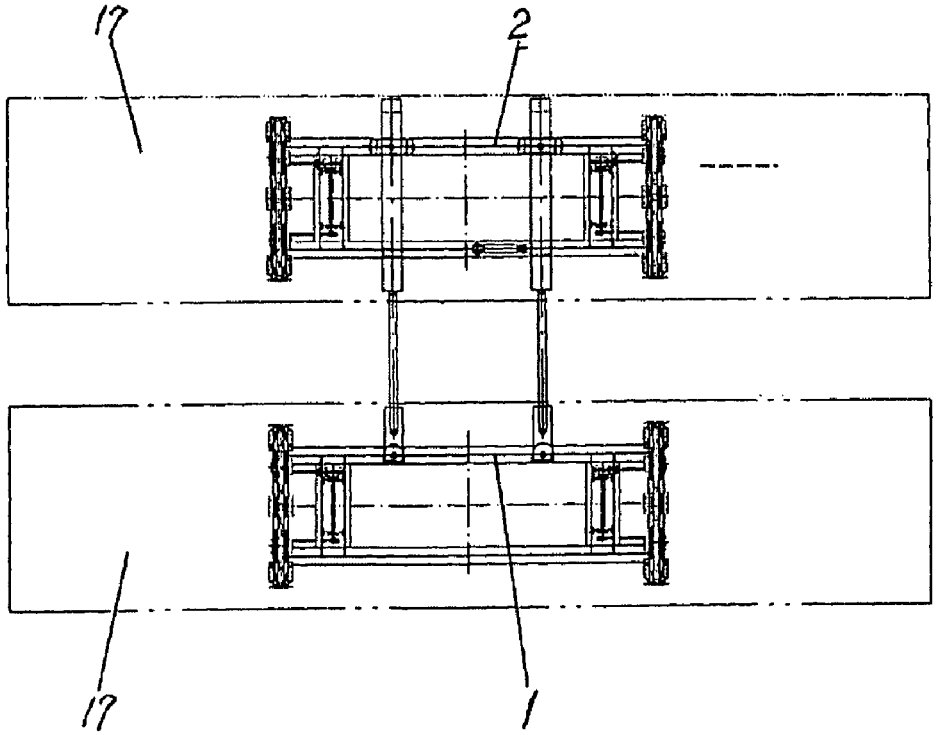
FIG. 2 is a schematic view used to show the increase of the distance between two head blocks and the spreaders mounted thereon.
Figure 3:
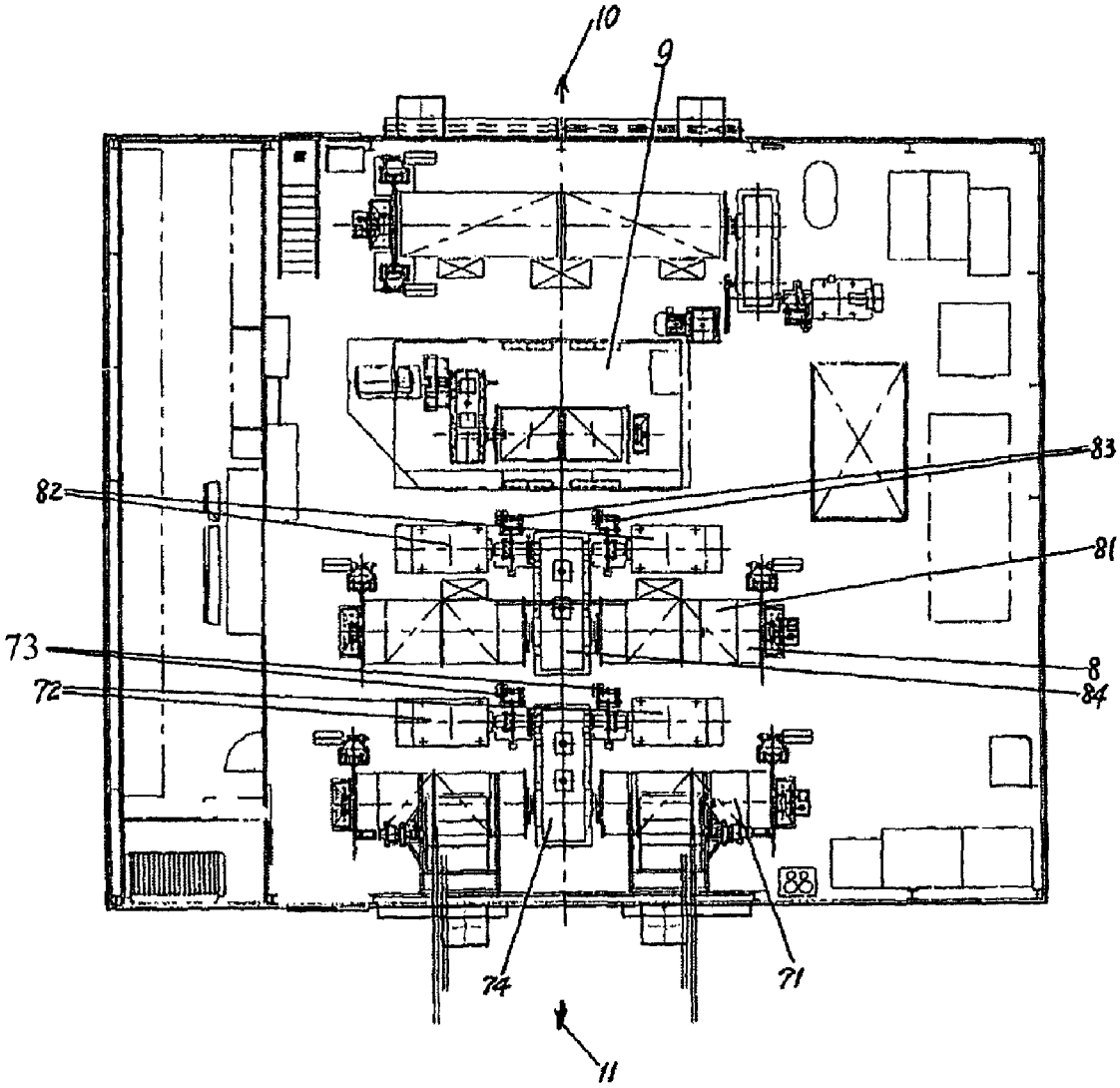
FIG. 3 illustrates two sets of the hoisting mechanisms of the hoisting devices in the machine room.
Figure 4:
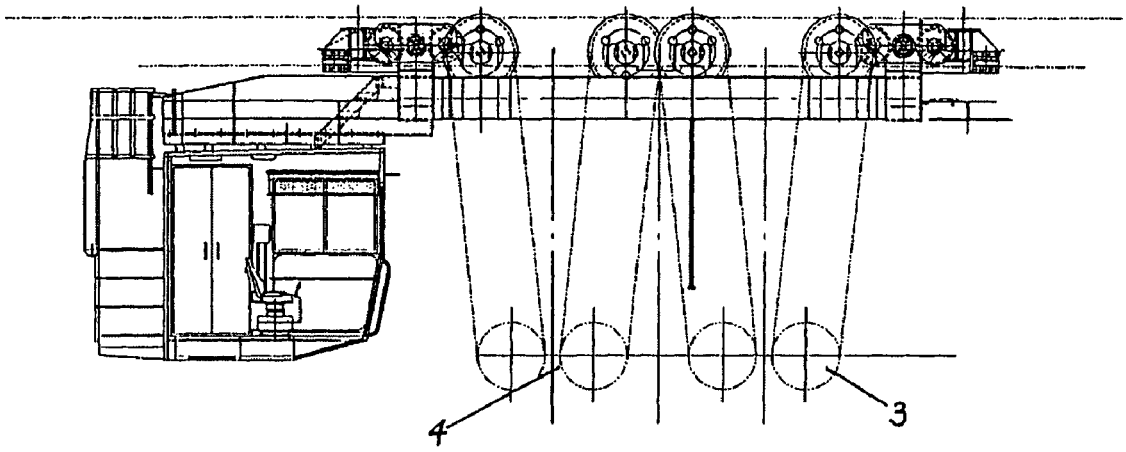
FIG. 4 is a side view of the arrangement of the hoisting pulleys and the head block pulleys.
Figure 5:
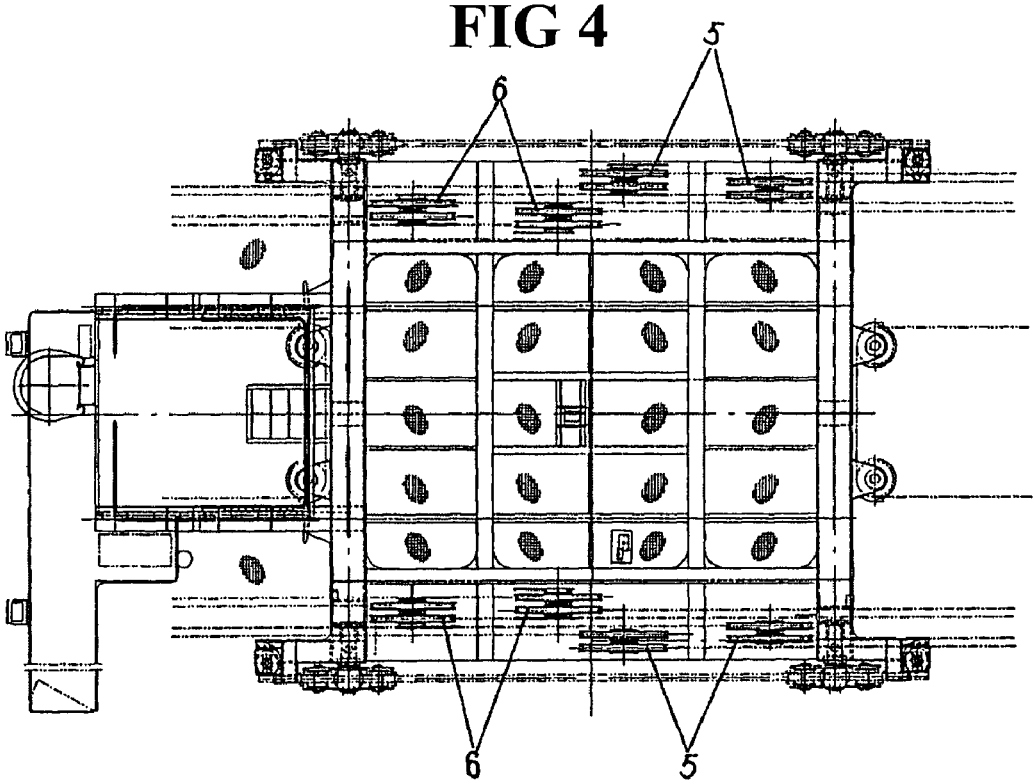
FIG. 5 is a plan view of the arrangement of the hoisting pulleys and the head block pulleys.

Reference to FIGS. 1 to 5, an embodiment of the container crane of the present invention being able to hoist two 40 feet containers at a time is equipped with two separate hoisting devices, a first hoisting device 1 and a second hoisting device 2, each of the hoisting devices has its own hoisting mechanisms, and a wire rope winding system for simultaneously operate the two hoisting mechanisms is also provided, the first hoisting device 1 and the second hoisting device 2 is connected by a connection cylinder. Head block pulleys are arranged on the head blocks of the hoisting devices and hoisting pulleys are arranged on the trolley, wherein each hoisting device has its own head block pulleys and hoisting pulleys. As shown in FIG. 4 and FIG. 5, the first hoisting device 1 uses a first hoisting pulley 5 and a first head block pulley 12, and the second hoisting device 2 uses a second hoisting pulley 6 and as second head block pulley 13. The position of the first head block is denoted by the reference numeral 3 and the position of the second head block is denoted by the reference numeral 4 in FIG. 4.

As shown in FIG. 3, the first hoisting mechanism 7 of the first hoisting device 1 and the second hoisting mechanism 8 of the second hoisting device 2 are equipped with a winding barrel 71 and a second winding barrel 81, a first hoisting mechanism motor 72 and a second hoisting mechanism motor 82, a first brake 73 and a second_brake 83, and a first hoisting reduction gear box 74 and a second hoisting reduction gear box 84 respectively. The first hoisting mechanism 7 and the second hoisting mechanism 8 are connected by a wire rope winding system so as to make the first_hoisting mechanism 7 and the second hoisting mechanism 8 work simultaneously. A hydraulic station is denoted by the reference numeral 9, the water side and the land side are denoted by the reference numerals 10 and 11 respectively.

The first hoisting mechanisms 7 and the second hoisting mechanism 8 are synchronously operated by electrical synchronization or by mechanical synchronization so that the two sets of reduction gear boxes are combined as one set in order to operate two 40 feet containers. A single 40 feet container of 60 t under the crane is operated or two 20 feet containers of 60 t under the crane are operated when the weight of two 40 feet containers exceeds the designed value. The operation of a single 40 feet container of 60 t under the crane or the operation of two 20 feet containers of 60 t under the crane may be achieved by the separate individual use of the two hoisting mechanisms. If a reduction gear box is shared between the two hoisting mechanisms, the output of the reduction gear box and power mechanism is directed only to a set of the winding barrel.

Figure 1:
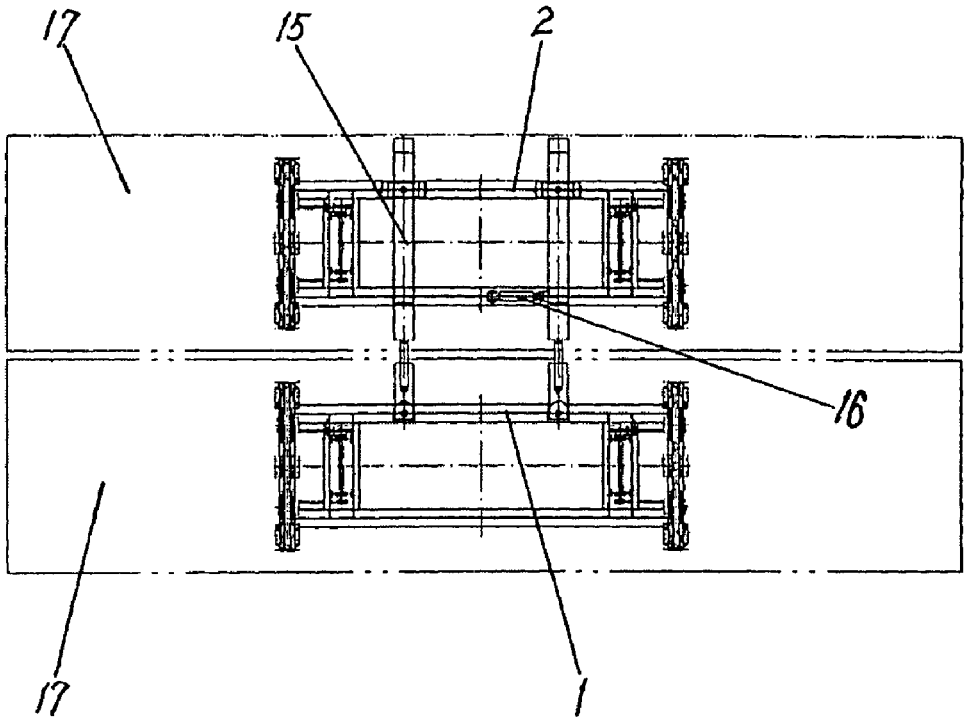
FIG. 1 is a schematic view used to show the two head blocks and the spreaders mounted thereon of the crane having two hoisting devices, being able to hoist two 40 feet containers at a time according to the present invention.

As shown in FIG. 1, the approach and separation of the two head blocks and the spreaders mounted thereon are achieved by a connection cylinder 15 between the first head block of the first hoisting device 1 and the second head block of the second hoisting device 2. The reference numeral 16 shows a shifting cylinder arranged in a direction along the length of the hoisting device in the figure. FIG. 2 shows the situation in which the two hoisting devices are spaced apart. The rectangles 17 show a single 40 feet container or two 20 feet containers in FIGS. 1 and 2.

The two 20 feet separable spreaders and their head blocks are arranged at the water side and land side respectively, the two separable head blocks and the spreaders mounted thereon are connected by two cylinders being arranged parallel, and the joint of the head blocks is connected by sphere gemels so as to achieve the approach and separation of the two head blocks and the spreaders mounted thereon. The centre distance between the two head blocks and the spreaders mounted thereon is 2500 mm when the two hoisting devices are closed, the centre distance is 3700 mm when the two head blocks and the spreaders mounted thereon are separated, thus the range of the gap between the two containers is from 0 to 1200 mm. The shifting of the two head blocks and the spreaders mounted thereon in the direction along the length of the containers is attained by the shifting cylinder 16, the range of the shifting distance is from 0 to 400 mm.

The loading and unloading of two 40 foot containers in any position can be achieved by fast releasing of the connection of the cylinders of the two hoisting-devices, also one of the two 20 feet hoisting devices can be hoisted to its highest position i.e. in the unused position. The loading and unloading of a 40 feed container with 60 t weight or two 20 feet containers with 60 t can be achieved by another hoisting device. The fixing of containers of the two 40 feet container cranes is performed sequentially, i.e. the fixing and locking of containers by the first hoisting device is performed first, then the fixing and locking of containers by the second hoisting device is performed. After the fixing and locking of the two 40 feet containers is confirmed, the two 40 feet containers are hoisted and operated at same time. If the gap between two 40 feet containers accidentally exceeds the stretch and contraction range of the cylinder, the fixing of a container by one of the hoisting device is performed first, then the trolley is operated so that the fixing of a container by the second hoisting device can be operated, thus flexibility can be achieved.

If the weight of two 40 feet container exceeds 80 t and the operation of the two 40 feet containers can not be carried out at same time, one of the hoisting devices must be hoisted and fixed to the highest position by the hoisting mechanism, the operation of two 20 feet containers with 60 t weight or a single 40 feet container with 60 t weight may be carried out by the other hoisting device.

Figure 6:
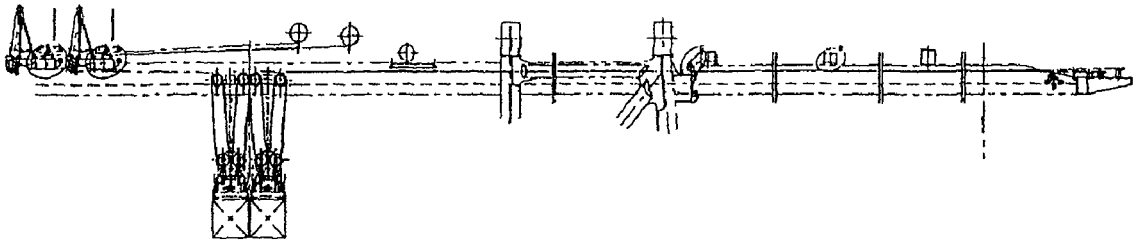
FIG. 6 is a schematic view of the wire rope winding system.
Figure 7:
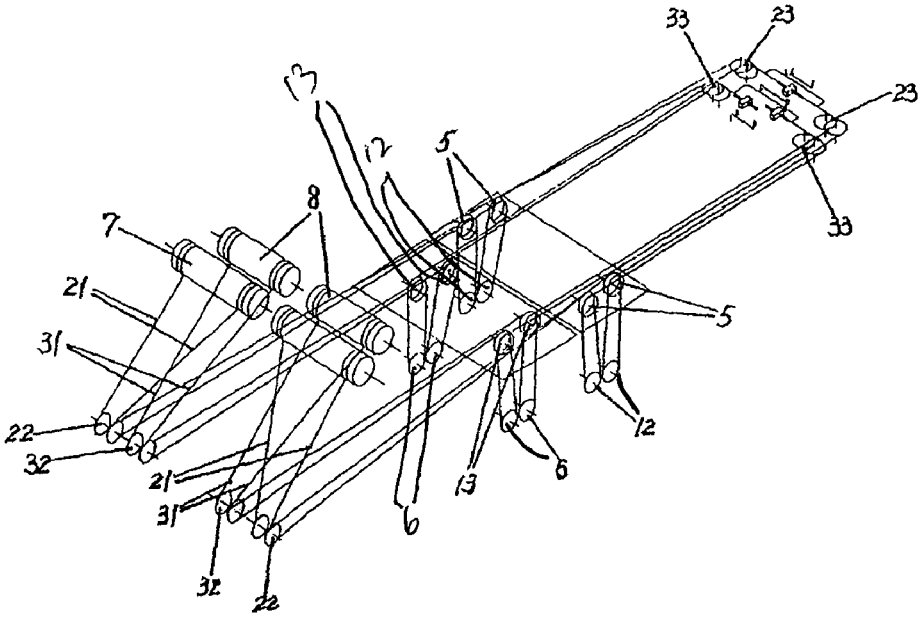
FIG. 7 is a schematic perspective of the main lifting wire rope winding system.

With reference to FIGS. 6 and 7, two hoisting mechanisms can be synchronously operated by the wire rope winding system of the present invention.

As shown in FIG. 7, a first hoisting wire rope 21 unwinds from the first winding barrel 71 of the first hoisting mechanism 7, turns around a first end pulley 22, winds the first hoisting pulley group 5 on the trolley, reaches and winds the first head block pulley group including at least two first head block pulleys 12 and retraces to the first hoisting pulley group including at least two first hoisting pulleys 5, finally gets one terminal of the main front girder of the crane and connects to a first turning device including two pulleys 23. A second hoisting wire rope 31 unwinds from the second winding barrel 81 of the second hoisting mechanism 8, turns around a second end pulley 32, winds the second hoisting pulley group including at least two second hoisting pulleys 6 on the trolley, reaches and winds the second head block pulley group including at least two second head block pulleys 13 and retraces to the second hoisting pulley group 6 on the trolley, finally gets one terminal of the main front girder of the crane and connects to a second turning device including two pulleys 33.

The invention claimed is:

1. A container crane for hoisting two 40 feet containers at a time, comprising:

a first hoisting device having a first head block, a first spreader, a first winding barrel, a first hoisting mechanism motor, a first brake, a first hoisting reduction gear box, a first head block pulley group including at least two first head block pulleys and a first hoisting pulley group including at least two first hoisting pulleys, wherein the first hoisting pulley group is arranged on a trolley, and the first head block pulley group is arranged on the first head block;

a second hoisting device having a second head block, a second spreader, a second winding barrel, a second hoisting mechanism motor, a second brake, a second hoisting reduction gear box, a second head block pulley group including at least two second head block pulleys and a second hoisting pulley group including at least two second head block pulleys, wherein the second hoisting pulley group is arranged on the trolley and the second head block pulley group is arranged on the second head block;

a connection cylinder for bringing together and separating the first head block and the first spreader mounted thereon and the second head block and the first spreader mounted thereon in a direction perpendicular to length of the containers; and one wire rope winding system, for connecting the first hosting device and the second hoisting device through a first hoisting wire rope and a second hoisting wire rope, wherein the first hoisting device and the second hoisting device work simultaneously;

wherein the first hoisting wire rope unwinds from the first winding barrel, turns around a first end pulley, winds the first hoisting pulley group on the trolley, reaches and winds the first head block pulley group and retraces to the first hoisting pulley group, and reaches one end of a main front girder of the container crane and connects to a first turning device, wherein the first turning device comprises a first plurality of pulleys;

the second hoisting wire rope unwinds from the second winding barrel, turns around a second end pulley, winds the second hoisting pulley group on the trolley, reaches and winds the second head block pulley group and retraces to the second hoisting pulley group, reaches a second end of the main front girder of the container crane and connects to a second turning device, wherein the second turning device comprises a second plurality of pulleys; and wherein if a weight of two 40 feet container exceeds a predetermined weight, one of the first hoisting device or the second hoisting device are lifted and fixed, and only one of the first hoisting device or the second hoisting device operates; and if a weight of two 40 feet container does not exceed the predetermined weight, both the first hoisting device and the second hoisting device operate.

2. The container crane of claim 1, further comprising:

a shifting cylinder, arranged on the first spreader at a position between the first and second head blocks for shifting the first and second spreaders in a direction parallel to the length of the containers.

* * * * *